US005110137A

United States Patent [19]

Watkins et al.

[11] Patent Number: 5,110,137

[45] Date of Patent: May 5, 1992

[54] INFRARED TARGET USING GAS PERMEABLE MATERIAL

[75] Inventors: Lawrence J. Watkins; Roland Fuentes, Jr., both of Huntsville, Ala.

[73] Assignee: Teledyne Industries Incorporated, Los Angeles, Calif.

[21] Appl. No.: 667,210

[22] Filed: Mar. 11, 1991

[51] Int. Cl.[5] ..... F41J 1/00

[52] U.S. Cl. ..... 273/348.1

[58] Field of Search ..... 273/348.1; 165/177, 165/180, 181

[56] References Cited

U.S. PATENT DOCUMENTS

| | | | |
|---|---|---|---|
| 240,267 | 4/1881 | Pope | 165/180 X |
| 4,346,901 | 8/1982 | Booth | 273/348.1 |
| 4,405,132 | 9/1983 | Thalman | 273/348.1 |

*Primary Examiner*—William H. Grieb

*Attorney, Agent, or Firm*—Beveridge, DeGrandi & Weilacher

[57] ABSTRACT

Target capable of producing a desired infrared signature of an intended target object. Heated gas is transported through a thermal system. Gas leaks out of the system at locations constructed of gas-permeable material. Gas-permeable locations are selectively placed to create the desired infrared signature of the intended target object.

15 Claims, 6 Drawing Sheets

INFRARED TARGET USING GAS PERMEABLE MATERIAL

BACKGROUND OF THE INVENTION

1. Field of the Invention

The present invention relates to targets, more particularly to object simulators and to a method for effectively converting power contained in a heated airstream into specific infrared radiation in a controlled manner to bring about a desired effect. According to the invention, the infrared radiation is produced at various specified intensities and locations to generate a desired characteristic infrared signature. The infrared signature generated thereby is then used to simulate the infrared signature produced by objects that would be targets for an infrared tracking weapon, such as armored vehicles, support vehicles, and the like. Because of the method used to produce infrared radiation, this invention will improve the quality of infrared signatures produced by object simulators and reduce the size of the power supplies required to produce the infrared signatures.

2. Description of the Prior Art

It is known in the art to generate infrared specific signatures for decoys or target systems for heat-sensing weapons or devices. The infrared signature of a specific target object, such as a tank or personnel carrier for example, is known, and a target made to simulate the target object is constructed to produce a like infrared signature.

A variety of techniques have been used for this purpose. The techniques commonly used by the U.S. Army employ electricity and resistive heating as the power transfer medium. Electricity is produced by an electrical generator which is typically driven by a gasoline or diesel-fueled internal combustion engine. The electricity conducts through heating elements. As current conducts through the elements, heat is generated and released in the form of infrared radiation at specified locations, producing the desired infrared signature of an intended target object.

Another method of generating a desired infrared signature uses heated air as the power transfer medium. This method passes a heated airstream between two carefully located gas impermeable sheets to raise the surface temperature of the sheets, thereby producing the desired infrared signature of an intended target object.

A third method uses heat created by chemical reactions. One of these uses plastic bags containing isolated portions of calcium chloride and water. When the bag is struck, the calcium chloride and water mix together causing a heat producing chemical reaction. The result is that the temperature of the bags rises, thereby generating an infrared signature like that of the intended target object.

All three of these prior art methods of generating an infrared signature have significant disadvantages. For example, the electrical/resistive systems are heavy, and the signature they create is weak and easily affected by the wind. Furthermore, the fuel for the electrical generators is volatile, and the heating elements tend to fail when folded repeatedly. The heated air systems are also easily effected by the wind, and the power supplies for this type of system are large and heavy. Finally, the chemical approach only provides about two hours of operation. This is far below the operating time generally desired for most applications.

SUMMARY OF THE INVENTION

An object of this invention is to provide a device for producing infrared signatures in a controlled manner according to a desired pattern of intensities and patterns with a thermal system reduced in size and weight from the prior art.

A further object of the present invention is to provide a method for creating an infrared signature by moving a heated gas through a thermal system comprised of gas permeable material, such that the gas is allowed to leak out of the thermal system at desired locations. An advantage of this invention resides in it not being easily affected by wind, and providing the desired signature for the necessary period of time.

The invention disclosed below is a thermal system to conduct heated gases, such as air. The walls of this conducting system are made up of both gas-permeable and gas-impermeable materials. As the heated gas flows through the system, it leaks out where the system walls are constructed with the gas permeable material. This leakage presents a stable infrared signature that is not easily affected by wind. This system is very efficient, since the heated gas passes through the material generating the signature of the intended target object, providing enhanced heat transfer since the heat is not conducted through a second medium. To obtain a specific infrared signature, the system walls need only to be constructed of the gas-permeable material at locations which will create the desired specific signature of the intended target object which can be, for example, a tank, a mobile missile launcher, or the like.

BRIEF DESCRIPTION OF THE DRAWINGS

The present invention will be further understood with reference to the drawings herein.

THEORY OF THE INVENTION

Figure 1:
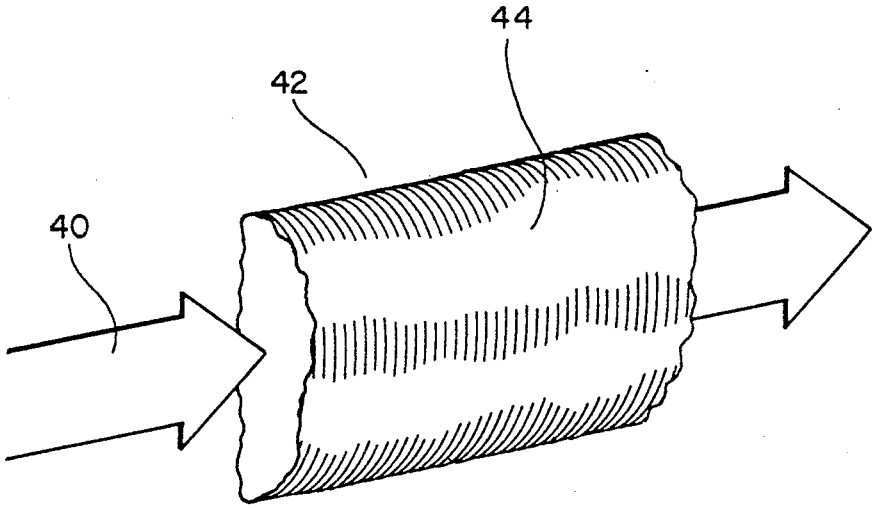
Fig. 1 (PRIOR ART)
FIG. 1 shows a prior art system using heated air conducted by all gas permeable walls.

Conventional heated air systems pass heated air between two air-impermeable materials, as shown in FIG. 1. The heated air transfers heat to the inner surface of the material by convection and to the outer surface, intended to produce the infrared signature, by conduction.

Figure 2:
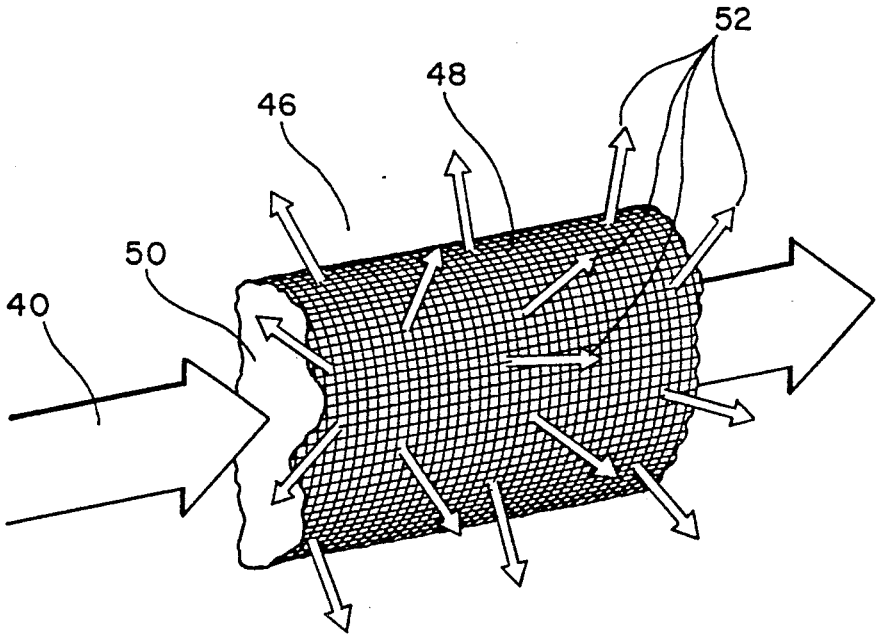
FIG. 2 shows a preferred embodiment of a thermal system of the present invention using heated gas conducted by walls made of both gas permeable and gas impermeable materials.

The essential component of the present invention is a passageway to permit heated gas to pass through, as shown in FIG. 2. The passageway is constructed at least partially of a gas permeable fabric material. The remaining portion of the passageway is defined by a gas impermeable material so as to enable a stream of heated gas to pass between the two materials defining the passageway. The cross section of the passageway can be of any desired configuration consistent with the overall design of the system. The permeable fabric allows some portion of the heated gas to pass through the permeable fabric, heating the fibers. The permeable fabric portion of the passageway enables the heated air to escape from the target structure thereby producing the desired infrared signature of the intended target object according to the predetermined target pattern that is desired be produced. The gas passing through the fabric enables a better temperature control than the previous heated gas approach.

Figure 4:
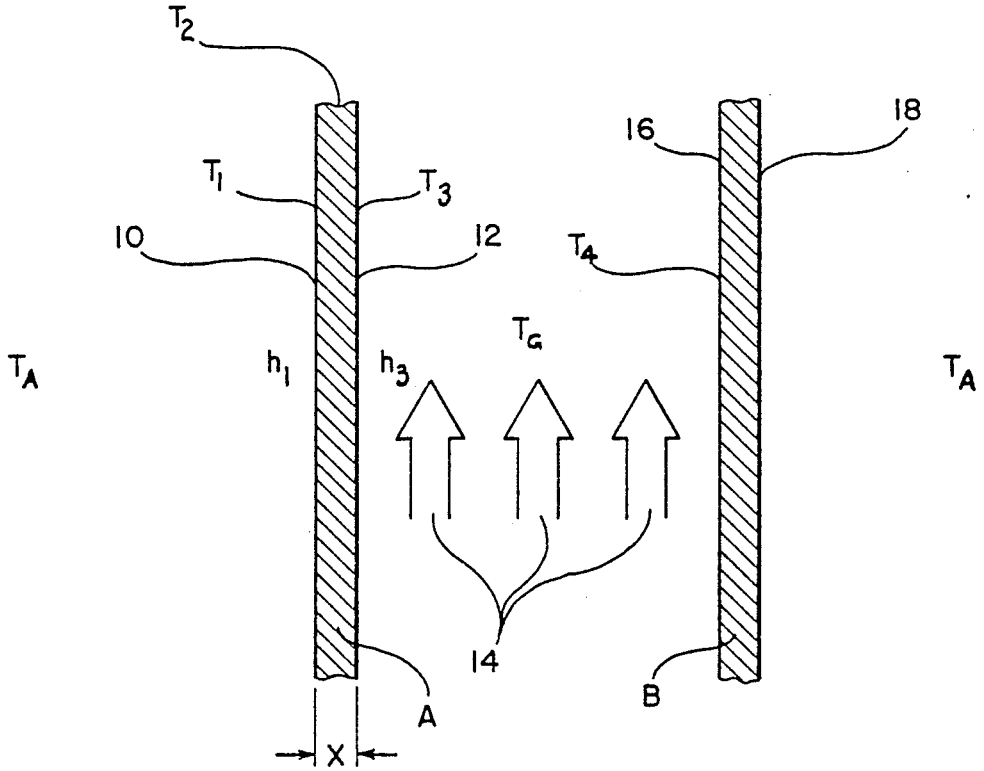
FIG. 4 illustrates heat transfer mechanisms for heated air thermal target systems in accordance with the prior art.

FIG. 4 shows the cross section schematic of a heated air thermal target system. Neglecting the radiative losses, heat is transferred to surface (10) by conduction through material (A) from surface (12). Surface (12) obtains heat by convection from the heated air at Tg. From a heat balance:

$$Q_1 = h_1 A(T_1 - T_a) \quad (1)$$

$$Q_2 = kA[(T_3 - T_1)/X] \quad (2)$$

$$Q_3 = h_3 A(T_g - T_3) \quad (3)$$

where:

$Q_1$—Heat Flux at Boundary 1
$Q_2$—Heat Flux at Boundary 2
$Q_3$—Heat Flux at Boundary 3
$h_1$—External Heat Transfer Coefficient
$h_3$—Internal Heat Transfer Coefficient
A—Area of Heat Flux
K—Thermal Conductivity of Material "A"
X—Material Thickness of Material "A"
$T_a$—External Air Temperature
$T_1$—Temperature at Boundary 1
$T_2$—Average Temperature of Material "A"
$T_3$—Temperature at Boundary 3
$T_g$—Heated Air Temperature In terms of an overall heat balance:

$$Q_{tot} = UA(T_g - T_a) \quad (4)$$

$$Q_{tot} = Q_1 = Q_2 = Q_3 \quad (5)$$

where:

$$U = 1/(1/h_1 + x/k + 1/h_3) \quad (6)$$

U=Overall Heat Transfer Coefficient.

From Equations (1) and (5) it is seen that in order to maximize $T_1$, producing the maximum amount of infrared radiation emitted from surface (10), for given Tg, the heat transfer process must be maximized. For a gas impermeable fabric, the external heat transfer coefficient, $h_1$, is determined predominantly by the ambient wind speed. The internal heat transfer coefficient, $h_3$, is determined by the internal air flow rate (14) between material (A) and (B). For gas impermeable materials, there is no capability to control $h_1$, while $h_3$ is influenced by the internal flow velocity, which can be varied, but in most practical cases not enough to improve the surface temperature control.

Assuming very thin materials are used for material (A), it can be shown that the average temperature of material (A), $T_2$, is defined by:

$$T_2 = \frac{h_1 * T_1 + h_3 * T_3}{h_1 + h_3} \quad (7)$$

For a gas-impermeable material, $h_1$ will increase with increasing wind speed and $h_3$ will not change substantially. For a thin material, where $T_1 = T_2 = T_3$, the surface temperature of the material producing the infrared radiation will vary as a function of wind speed; consequently, the energy radiated will vary.

According to the present invention, the heated gas system with a gas-permeable fabric front offers the following advantages over the gas-impermeable systems:

1) Higher temperatures of material (A) are obtained due to increased heat transfer between the material (A) and the heated air.

Improving the heat transfer process between the heated air and the material produces the capability for higher surface temperature and better controlled surface temperatures for heated gas system using permeable fabrics for the surface material. As the gas passes through material (A), heat transfer between the air and material (A) is increased because more gas contact at higher local velocities is produced with the fabric. This in turn increases $h_3$. From Equation (7) it is seen that an increase in $h_3$ results in an increase of $T_2$.

2) Gas forced through material (A) reduces the effect that wind has upon the heat transfer coefficient at surface (10), resulting in a higher and more stable temperature for material (A).

After the heated gas passes through material (A), it forms a layer of heated gas over the fabric. This layer reduces the interaction of wind with surface (10), reducing $h_1$. By reducing $h_1$ it is seen from Equation (7) that the ultimate temperature of material (A) will be increased.

3) Due to the partial transmittance of infrared radiation by the fabric, radiation emitted from material (B) contributes to the total infrared radiation seen when viewing surface (10).

The infrared transmission of the fabric at surface (10) allows radiation emitted from surface (16) to add to the radiation emitted by surface (10). By insulating surface (18), reducing heat losses to ambient wind, the temperature $T_4$ can be more easily controlled at a certain temperature. When viewing surface (10) with an infrared imager, radiative contributions from surface (10) and surface (16) are seen. By stabilizing surface (16) and reducing the effects of wind at surface (10), a fairly constant level of infrared radiation may be produced with only minimal effects from varying ambient wind velocity.

4) Due to the benefits realized in the previously mentioned advantages, the gas temperatures needed to operate the thermal system will be cooler than with existing systems. This will lead to a lighter and more compact power supply.

EXPERIMENTAL RESULTS

Figure 5:
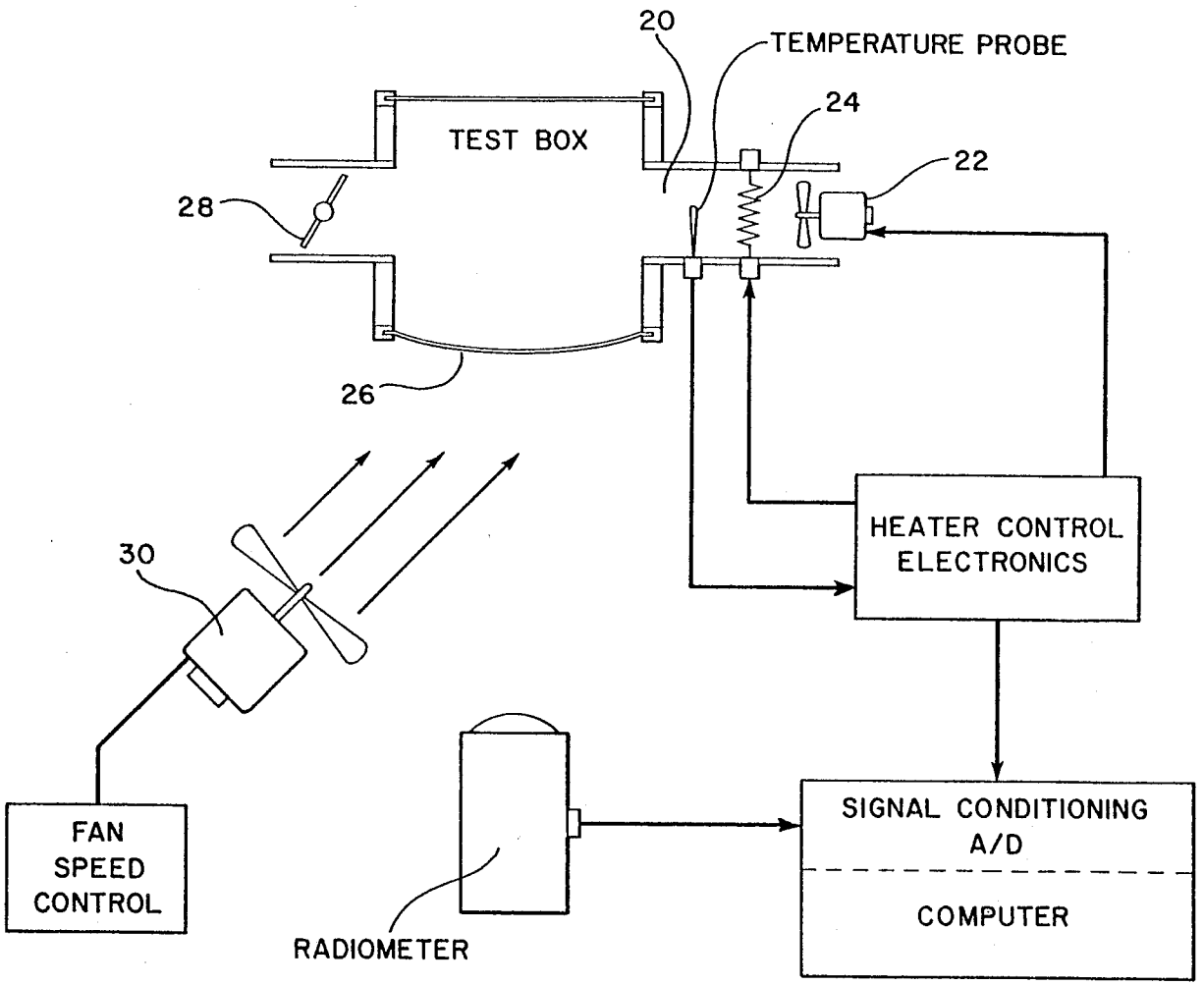
FIG. 5 shows the layout used to test the efficiency of embodiments of the present invention.
Figure 6:
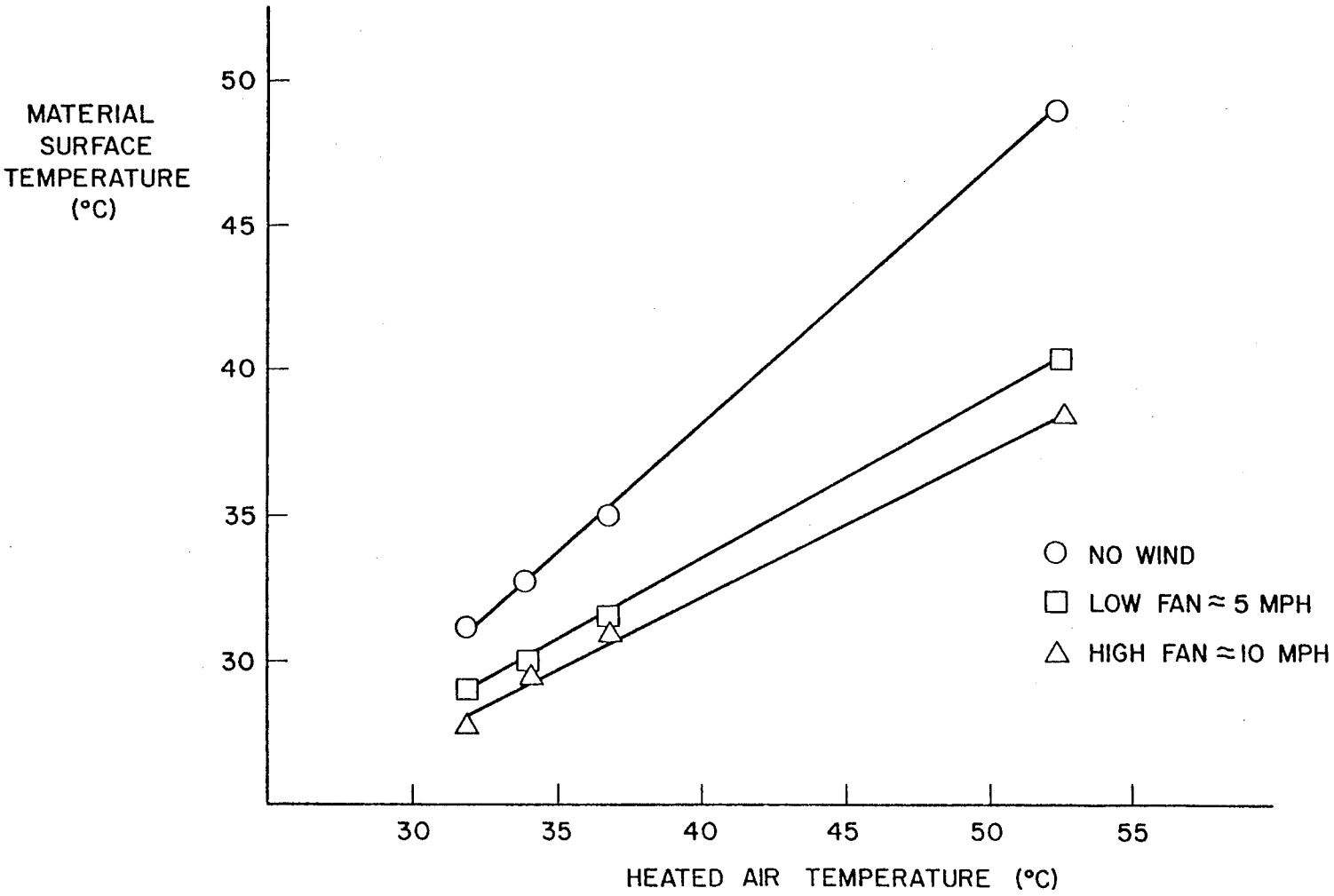
FIG. 6 illustrates the experimental results obtained when black polyethylene is used as a wall material.
Figure 7:
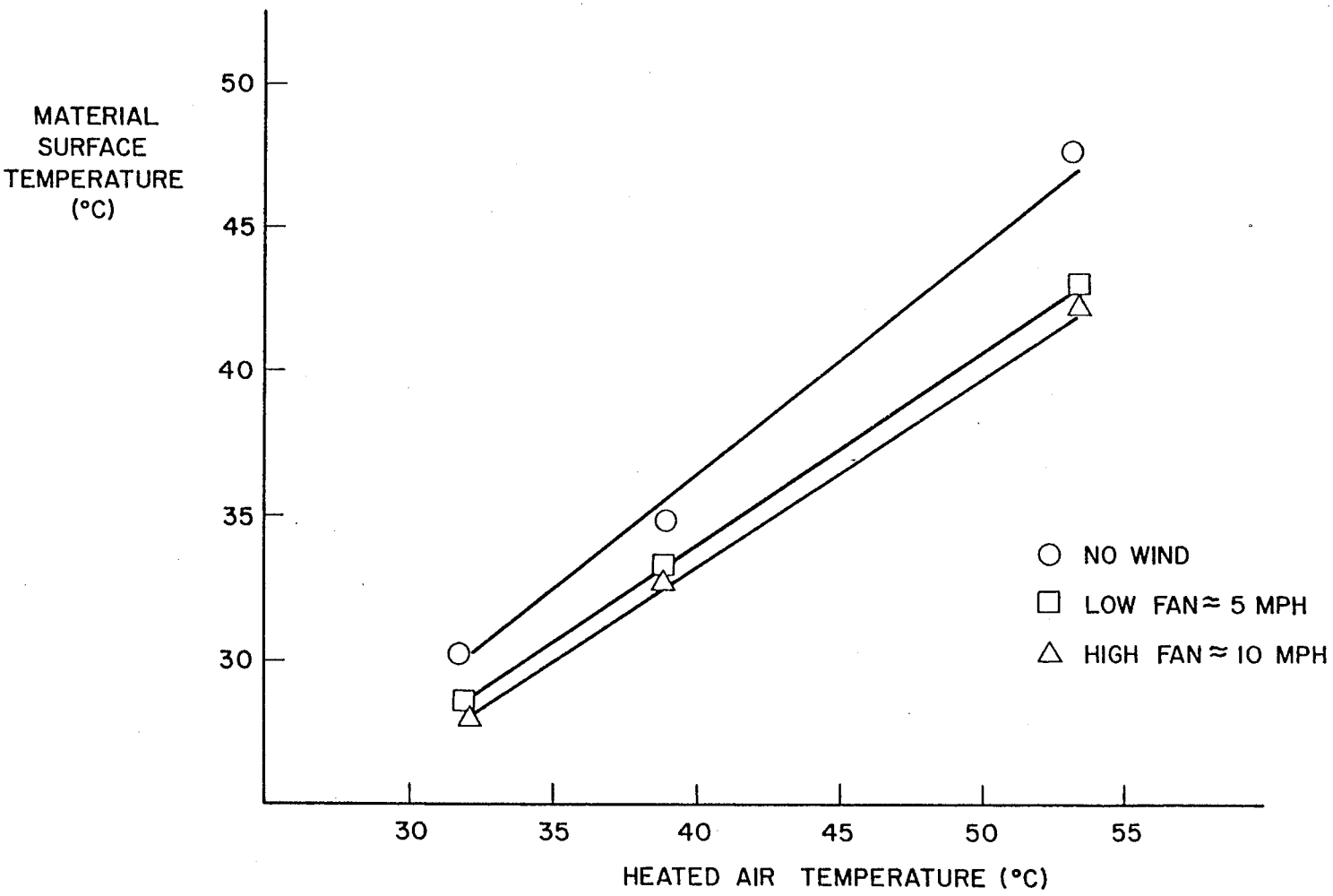
FIG. 7 shows the experimental results obtained when thick weave cloth is used as a wall material.
Figure 8:
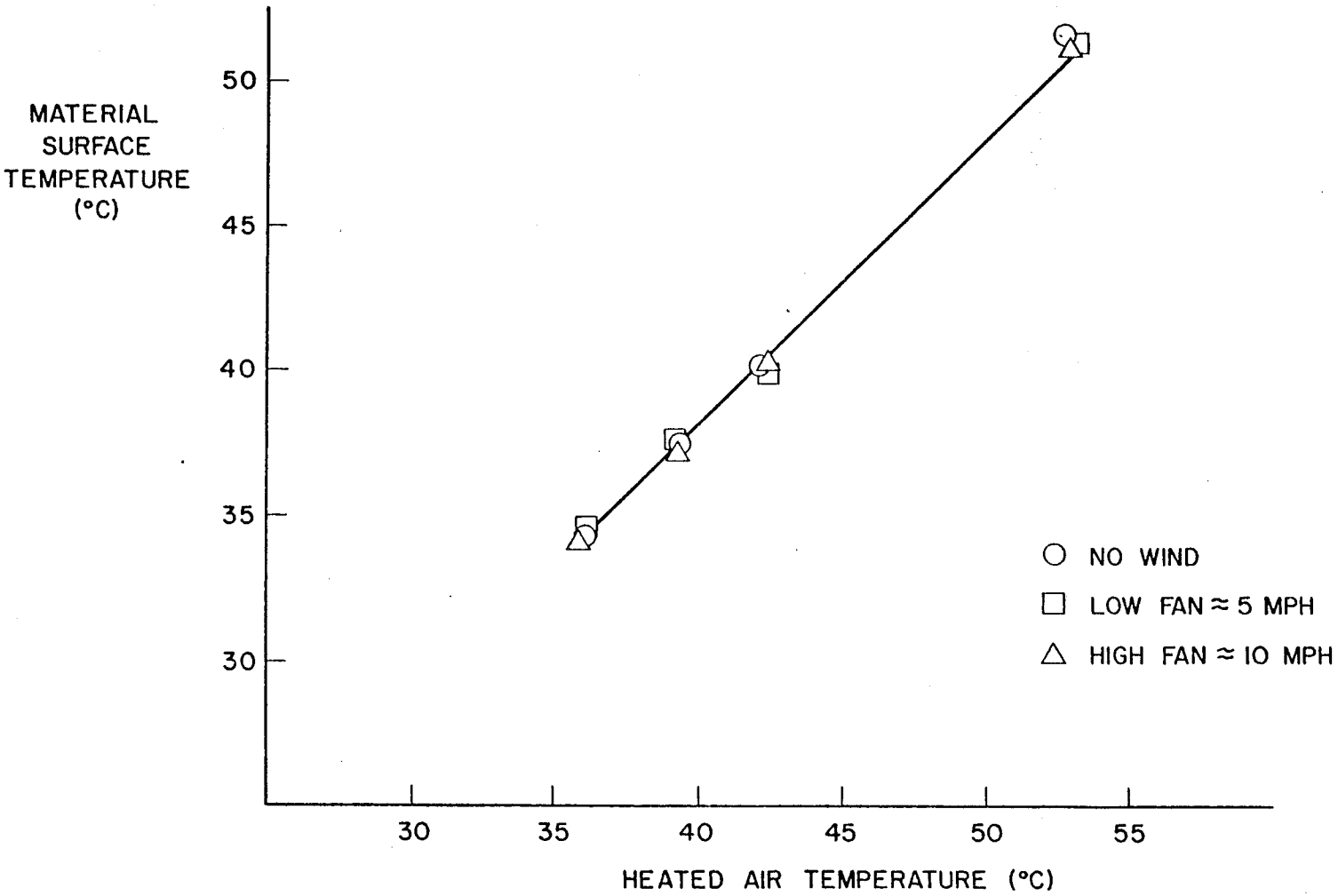
FIG. 8 illustrates the experimental results obtained when polyester fabric is used as a wall material.

To evaluate the validity of the previously mentioned principles and advantages, an experiment was performed. A diagram of the experimental setup is shown in FIG. 5. A box was constructed having a heated air input port (20) where the air flow rate and temperature were controlled by a fan (22) and a heater element (24). The outlet of the box was either through a permeable material (26) covering one end, or through a positionable butterfly valve (28). Any suitable material could be placed over the box opening to be studied. The surface temperature of the material was measured using a pyrometer while the air temperature was measured using a thermocouple. The choice of measuring devices allowed easy comparison of the internal air temperature and the material surface temperature, which is shown in FIGS. 6 through 8. A two-setting fan (30) was used to force cooler ambient air against the material to be tested, simulating wind conditions. The low speed fan setting equated to a wind of about 5 miles per hour, while the high speed fan setting was equivalent to about a 10 mile per hour wind.

In the first test, black polyethylene was placed over the box opening. The polyethylene covering produced only slightly cooler surface temperatures than the inside air, with no wind. When the wind was simulated the temperature of the polyethylene surface dropped considerably, as shown in FIG. 6.

The second test used a thick weave polyester fabric with a low permeability and a weight of about 14 ounces per square yard. The results are shown in FIG. 7, where some resistance to the cooling effect of the wind can be seen.

The third test used a thinner cloth weighing 10 ounces per square yard. The cloth had a permeability of about 8.5 cubic feet per minute (CFM) as determined by ASTM D 737-75, Air Permeability of Textile Fabrics. The third fabric had a higher permeability than the previous two fabrics, thereby allowing more air to pass through. The wind, at the speeds tested, had a minimal effect on the temperature of the cloth when viewed by the pyrometer, as shown in FIG. 8. The above described results of the experiment prove the validity of the concepts of the invention for increasing the temperature stability of thermal target systems. It also demonstrates that the same level of infrared radiation as in a conventional thermal target system can be generated with a lower temperature air by the present invention.

DESCRIPTION OF A PREFERRED EMBODIMENT

As previously mentioned in the discussion of the prior art, some infrared signature systems use a thermal system to transport heated air, as shown in FIG. 1. The heated air (40) flows through a duct (42), and some of the heat from the air is transferred through the walls of the duct to the outside surface (44). The temperature of this outside surface creates the desired infrared signature. As the surface of the wall is heated by conduction from air within, it is very susceptible to cooling by convection from the air without, particularly wind.

A preferred embodiment of the invention also uses a thermal system to transport heated air, as shown in FIG. 2. The heated air (40) flows through a duct (46) constructed of both air permeable material (48) such as a polyester fabric and air impermeable material (50) such as a polyethylene sheet. The air permeable material (48) allows a fraction of the heated air to escape (52) from the duct. This air creates an infrared signature directly, without having to conduct heat through a second medium.

Figure 3:
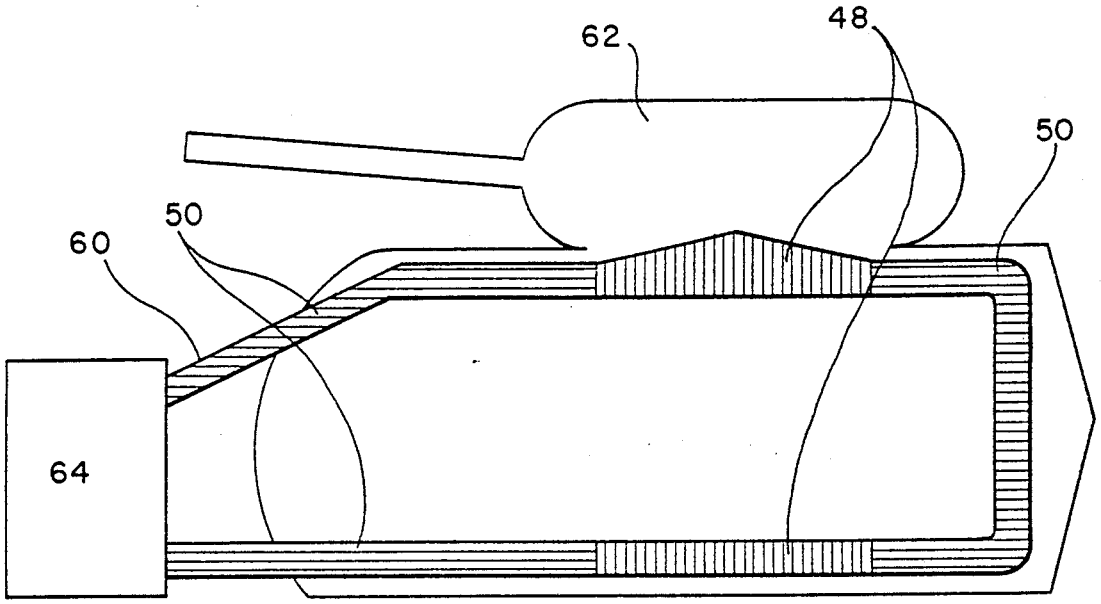
FIG. 3 shows a target according to a preferred embodiment of the present invention.

In a preferred embodiment, shown in FIG. 3, the duct work (60) is laid out on a plywood or metal frame (62) resembling the desired target object. At the approximate equivalent locations where the desired target object would normally give off an infrared signature, the walls of the duct work exposed as a target are comprised of an air permeable material (48), preferably one with a relatively high permeability. Desirable results have been obtained with a local (cloth surface) velocity of about 1.3 cubic feet per minute. Specifically, Applicants have used a fabric with a permeability of 3 to 35 cubic feet per minute in conjunction with an 85 cubic feet per minute fan. These values can therefore vary widely and are not intended to limit the scope of the claims. If a high capacity fan is used a correspondingly more permeable fabric be used to achieve a given heat signature.

The rest of the duct work is constructed of an air-impermeable material (50), so as to reduce unwanted infrared signatures from the system. The duct work is connected to a means for heating and blowing air (64), the size and power of which depend upon the length of the duct work and the desired temperature of the infrared signature of the intended target object.

A variety of permeable fabrics can be used both woven and non-woven, provided the fabrics are capable of creating, when installed in the system, the desired heat signature.

Further variations and modifications of the foregoing will be apparent to those skilled in the art and are intended to be encompassed by the claims appended hereto.

What is claimed is:

1. A device for generating a specific infrared signature of an intended target object, comprising:

a thermal system for the transport of heated gases, having a plurality of walls, at least one of said walls being comprised of a gas impermeable material, there being at least one of said walls whose surfaces are desired to present an infrared signature of an intended target object and is comprised of a gas permeable material.

2. A device according to claim 1 wherein said thermal system is constructed such that, when heated gases are transported by said thermal system, said walls consisting of a gas permeable material form a specific infrared signature of an intended target object, thereby presenting a simulated target object for an infrared targeting system, or other infrared tracking system.

3. A device according to claim 1 wherein said gas permeable material is a fabric.

4. A method for generating a specific infrared signature of an intended target object, comprising:

transporting heated gas through a thermal system formed of gas permeable areas and gas impermeable areas, and allowing said gas to leak out of said thermal system at gas-permeable locations, so as to present a desired infrared signature of an intended target object.

5. A method for generating a specific infrared signature according to claim 4, wherein said gas-permeable locations are placed so as to simulate an infrared signature of an intended target object.

6. A method for generating a specific infrared signature of an intended target object according to claim 4, wherein said gas-permeable locations are constructed of fabric.

7. A method for generating a specific infrared signature according to claim 4, wherein said heated gas is forced through said thermal system, thereby forcing heated gas through said gas-permeable locations.

8. A device for generating a specific infrared signature of an intended target object, comprising:

a thermal system for the transport of heated gases, having a plurality of walls, at least one of said walls being comprised of a gas impermeable material, there being at least one of said walls whose surfaces are desired to present an infrared signature of an intended target object and is comprised of a gas permeable material, and means for providing heated gases to be transported in said thermal system.

9. A device according to claim 8 wherein said thermal system is constructed such that, when heated gases are transported by said thermal system, said walls consisting of a gas permeable material form a specific infrared signature of an intended target object, thereby presenting a target object for an infrared targeting system, or other infrared tracking system.

10. A device according to claim 8 wherein said gas permeable material is a fabric.

11. A device according to claim 8, wherein said means for providing heated gases is adapted to force gas through said thermal system.

12. A method for generating a specific infrared signature of an intended target object, comprising:

heating gas to a desired temperature, transporting said gas through a thermal system formed of gas permeable areas and gas impermeable areas, and allowing said gas to leak out of said thermal system at gas-permeable locations, so as to present a desired infrared signature of an intended target object.

13. A method for generating a specific infrared signature according to claim 12, wherein said gas-permeable locations are placed so as to simulate an infrared signature of an intended target object.

14. A method for generating a specific infrared signature of an intended target object according to claim 12, wherein said gas-permeable locations are constructed of fabric.

15. A method for generating a specific infrared signature of an intended target object according to claim 12, wherein said gas is forced through said thermal system, thereby forcing gas through said gas-permeable locations.

* * * * *